US006471206B1

(12) United States Patent
Spina et al.

(10) Patent No.: US 6,471,206 B1
(45) Date of Patent: Oct. 29, 2002

(54) ADJUSTABLE TRAY AND METHOD FOR RECEIVING AND STORING SHEETS OF WEB MATERIAL

(75) Inventors: John A. Spina, Hamlin; John Depoint, Jr., Palmyra; Marion T. Juskiewicz, Webster, all of NY (US); Steven P. Hivner, Fort Collins, CO (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/635,819

(22) Filed: Aug. 9, 2000

(51) Int. Cl.[7] ..... B65H 31/20
(52) U.S. Cl. ..... 271/223; 271/171
(58) Field of Search ..... 271/171, 223, 271/207, 253; 211/51

(56) References Cited

U.S. PATENT DOCUMENTS

| | | | | | |
|---|---|---|---|---|---|
| 417,253 | A | * | 12/1889 | Lalof | 211/51 |
| 538,500 | A | * | 4/1895 | Bulkley | 211/51 |
| 2,060,146 | A | * | 11/1936 | Voorhees | 211/51 |
| 2,905,467 | A | * | 9/1959 | Zahradnik | 271/223 |
| 3,753,560 | A | | 8/1973 | Kapral et al. | |
| 3,807,725 | A | | 4/1974 | Bookless | |
| 3,921,972 | A | | 11/1975 | Miller | |
| 4,570,757 | A | | 2/1986 | Marzullo | |
| 4,697,803 | A | * | 10/1987 | Kan et al. | 271/171 |
| 4,786,042 | A | | 11/1988 | Stemmle | |
| 4,971,311 | A | | 11/1990 | Tsukimoto | |
| 5,014,091 | A | * | 5/1991 | Koike et al. | 271/223 |
| 5,023,669 | A | * | 6/1991 | Hatano et al. | 271/223 |
| 5,110,106 | A | * | 5/1992 | Matsumura et al. | 271/171 |
| 5,172,902 | A | | 12/1992 | Hashimoto et al. | |
| 5,333,852 | A | * | 8/1994 | Milillo et al. | 271/171 |
| 5,476,254 | A | | 12/1995 | Golicz | |
| 5,628,504 | A | * | 5/1997 | Lyga | 271/171 |
| 5,713,570 | A | | 2/1998 | Ouchi | |
| 6,302,390 | B1 | * | 10/2001 | Clark et al. | 271/171 |

* cited by examiner

*Primary Examiner*—H. Grant Skaggs
(74) *Attorney, Agent, or Firm*—Clyde E. Bailey, Sr.

(57) ABSTRACT

An adjustable tray for receiving and storing sheets of web material, such as photographic paper and film, has adjustable sheet width aligning and sheet receiving guide members that can alignably accommodate various sizes of paper. Independent quick release/latch mechanisms enable easy and quick deployment of the adjustable sheet width aligning and sheet receiving guide members.

20 Claims, 7 Drawing Sheets

ADJUSTABLE TRAY AND METHOD FOR RECEIVING AND STORING SHEETS OF WEB MATERIAL

CROSS-REFERENCE TO RELATED APPLICATIONS

The present application is related to U.S. application Ser. No. 09/635,376, filed Aug. 09, 2000, by Spinal et al., and entitled, "Sheet Processing Apparatus."

FIELD OF THE INVENTION

The invention relates generally to a tray for receiving and storing sheets of web material. More particularly, the invention concerns an adjustable tray and method that can receive and accommodate various size configurations of web material, such as photographic film and paper.

BACKGROUND OF THE INVENTION

Devices for storing and feeding sheets of paper are well known in the art. Such devices are commonly found in document processing equipment, such as copier machines, where sheets of paper are fed from a tray to an image development system where a pre-selected image is formed on the paper. Among several illustrative examples of this type of development are the ones disclosed in, for instance: U.S. Pat. No. 5,172,902, Dec. 22, 1992, titled "Paper Storing Device With A Swingable Engaging Member And An Engaging/Detaching Mechanism," by Hashimoto, et al.; U.S. Pat. No. 3,921,972, Nov. 25, 1975, titled "Sheet Stack Receptacle," by Miller; U.S. Pat. No. 5,713,570, Feb. 03, 1998, titled "Paper Supply Cassette And Paper Supply Device Having Paper Supply Cassette," by Ouchi; U.S. Pat. No. 3,753,560, Aug. 21, 1973, titled "Auxiliary Sheet Feeder," by Kapral et al.; and, U.S. Pat. No. 4,971,311, Nov. 20, 1990, titled "Feeder For Sheet-Feed Printing Machine," by Tsukimoto. The developments in the patents contemplate sheets of paper being fed from the tray to a processing device, such as a copier machine. However, to the surprise of the inventors, there appears to be no references that teach or suggest an adjustable tray into which paper of various sizes is align ably fed and stacked. Such applications could include sheets of paper fed from paper processing equipment, such as a chopper or slitter. The processed paper would then be stacked in the tray having novel and unobvious adjustable features for receiving paper of different dimensions and moved further down stream in a stacked array for further processing, such as inspection or packaging.

An existing practice for processing sheets of paper after processing includes feeding the sheets from a chopper into bins on an indexing conveyor. A shortcoming of this practice is that a full-time operator is required to remove each pack or stack of sheets as it was indexed to the last position. These packs are generally very cumbersome and can be as large as 35 mm×43 mm and could weigh 12 lbs. Moreover, the height of the index conveyor was 42 inches which causes ergonomic problems for the operator. The packs or stacks of paper had to then be accumulated on boards and then later transported to the next operation.

Therefore, a need persists in the art for a tray and method for receiving and storing sheets of paper that is adjustable to various widths and lengths of paper, can be quickly adjusted to accommodate various paper configurations, and is easy to use.

SUMMARY OF THE INVENTION

It is, therefore, an object of the invention to provide a tray that can receive and store sheets of web material, such as photographic paper and film, having a predetermined width and length.

It is another object of the invention to provide a tray having quick release and latch members for controlling width and length guide elements.

Yet another object of the invention is to provide a method of feeding sheets of paper into an adjustable tray after the paper is processed.

The present invention is directed to overcoming one or more of the problems set forth above. Briefly summarized, according to one aspect of the present invention, an adjustable tray for receiving and storing sheets of paper having a predetermined width and length, comprises a platform for stacking sheets of paper. A first lateral edge guide is arranged substantially normal to a second lateral edge guide on said platform. A width aligning guide member and a cooperating sheet receiving guide member are each arranged for movement on the platform. The width aligning guide member is adjustably movable along a first axis of the platform towards and away from the first lateral edge guide. The sheet receiving guide member is adjustably movable along a second axis of the platform towards and away from the second lateral edge guide.

In another aspect of the invention, a method of feeding sheets of paper into a tray includes the steps of providing the adjustable tray (described above) and at least one sheet of paper for feeding into the adjustable tray. The adjustable width and sheet receiving guide members are preset to correspond to a predetermined width and length of the sheets of paper being fed. The sheet of paper is positioned relative to a top edge of the second lateral edge guide so as to clear the top edge and then abut against a portion of the sheet receiving guide member. A leading edge of the sheet is then directed downwardly towards the sheet receiving guide member until the leading edge of the sheet contacts a portion of the sheet receiving guide enabling the sheet to settle on the platform bounded by the sheet receiving guide member, the first and second lateral guides and the width aligning guide member.

There are numerous advantageous effects of the present invention, including: the width of the product processed by the tray does not have to be equivalent to the length; the tray can accommodate various size configurations via use of a custom designed quick release/latch clip; the tray allows operator access for quick and easy removal of the product; and, the tray design allows sheets to be fed from a proprietary chopping machine into the trays in such a manner to stack the sheets uniformly with the sheet edges aligned, leaving no loose or wedged sheets.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
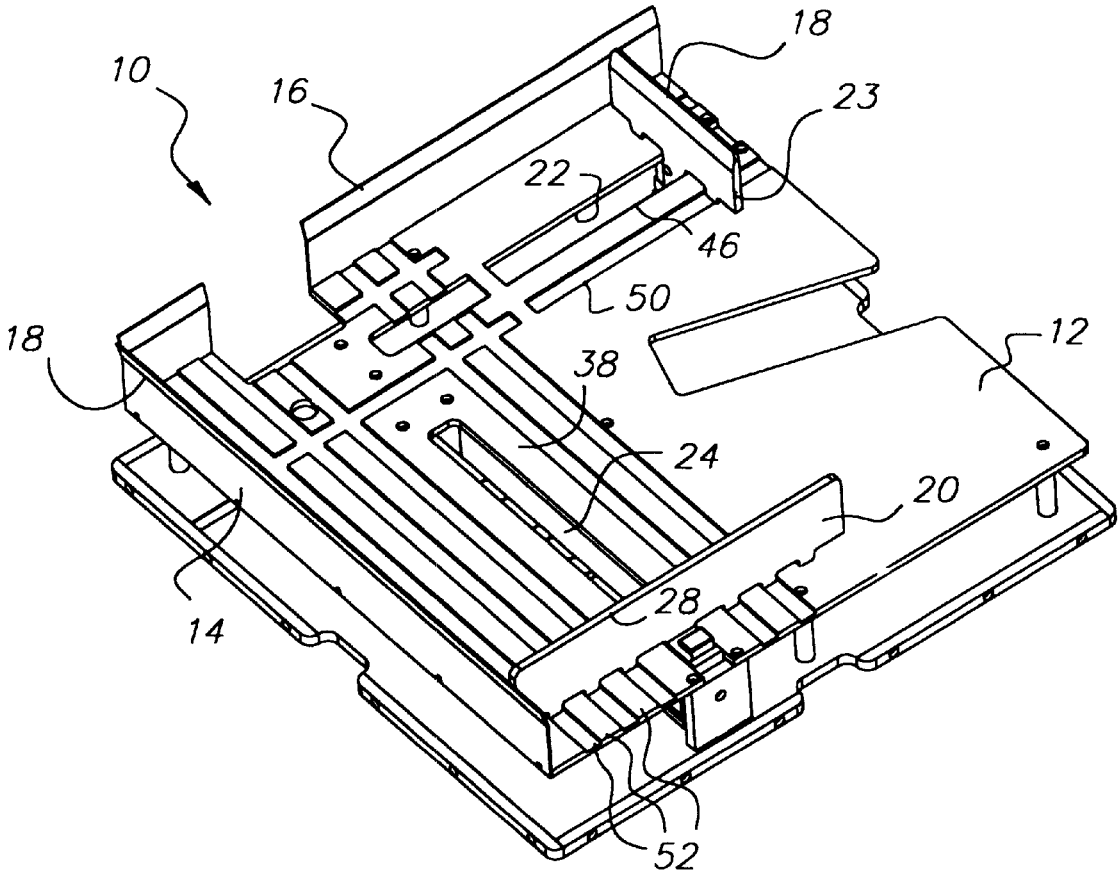
FIG. 1 is an isometric view of the outer top components of the tray.
Figure 2:
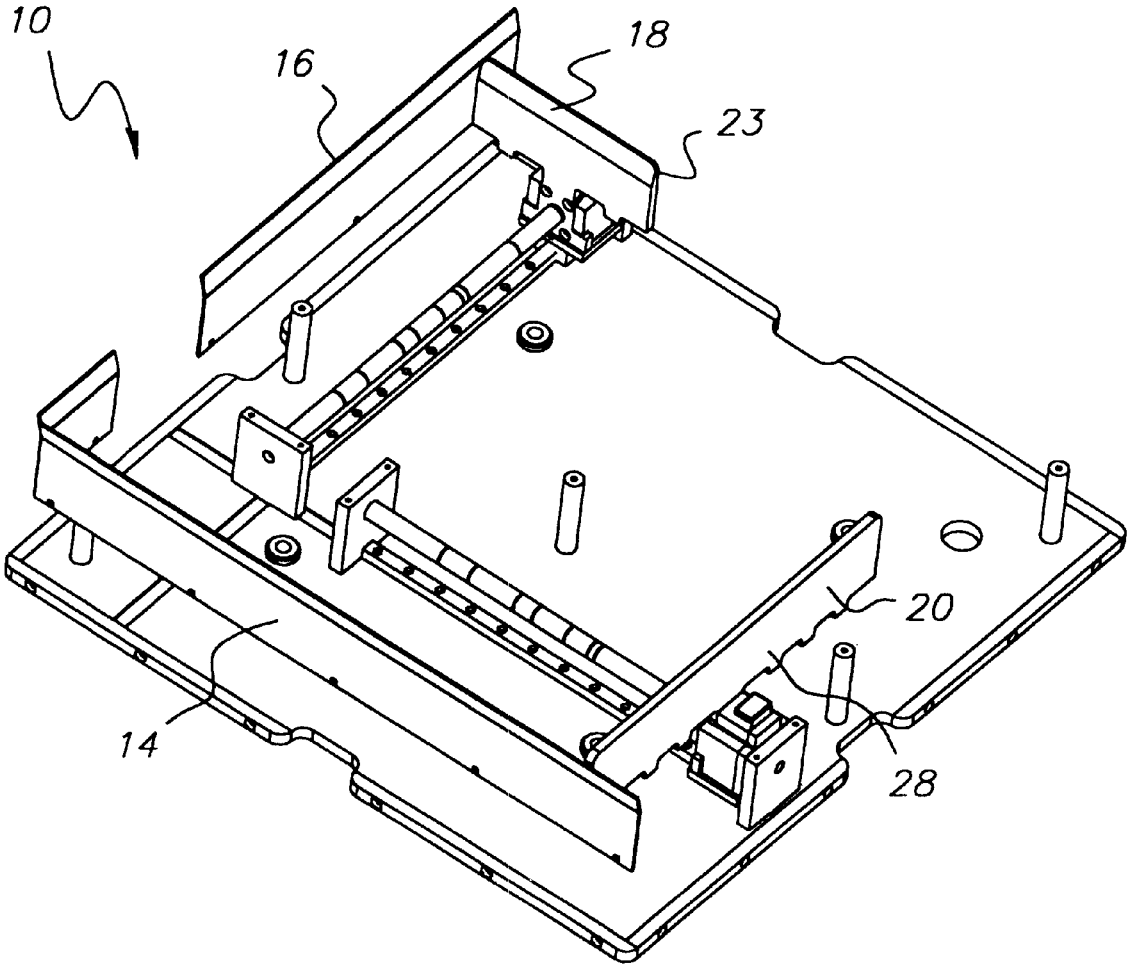
FIG. 2 is an isometric view of the internal components of the tray.

Turning now to the drawings, and in particular to FIGS. 1 and 2, the adjustable tray 10 of the invention is illustrated. Broadly defined, adjustable tray 10 for receiving and storing sheets of web material 1, such as photographic film and paper, having a predetermined width (w) and length (l) includes a platform 12 for stacking sheets of web material or paper 1. According to FIGS. 1 and 2, a first lateral edge guide 14 and a second lateral edge guide 16, both preferably fixed, are supported on platform 12. First lateral edge guide 14 is arranged substantially normal to second lateral edge guide 16 for align ably supporting the stack of paper being received by platform 12.

Referring again to FIGS. 1 and 2, sheet width aligning guide member 18 cooperates along platform 12 with an adjustable sheet receiving guide member 20. Sheet width aligning guide member 18 is arranged for adjustable movements along a first axis 22 of platform 12 towards and away from the first lateral guide 14 for align ably accommodating a predetermined width (w) of the sheets of web material or paper being fed to adjustable tray 10. In a preferred embodiment, sheet width aligning guide member 18 is substantially tapered along a top edge 23.

Still referring to FIGS. 1 and 2, sheet receiving guide member 20 is arranged for adjustable movements along a second axis 24 of platform 12 towards and away from second lateral edge guide 16. In addition to being the first point of contact of sheets of web material or paper fed to adjustable tray 10 (discussed below), sheet receiving guide member 20 enables the platform 12 to align ably accommodate sheets of web material or paper 1 having a predetermined length (l). In a preferred embodiment, sheet receiving guide member 20 is substantially flat along a top edge 28.

Figure 3:
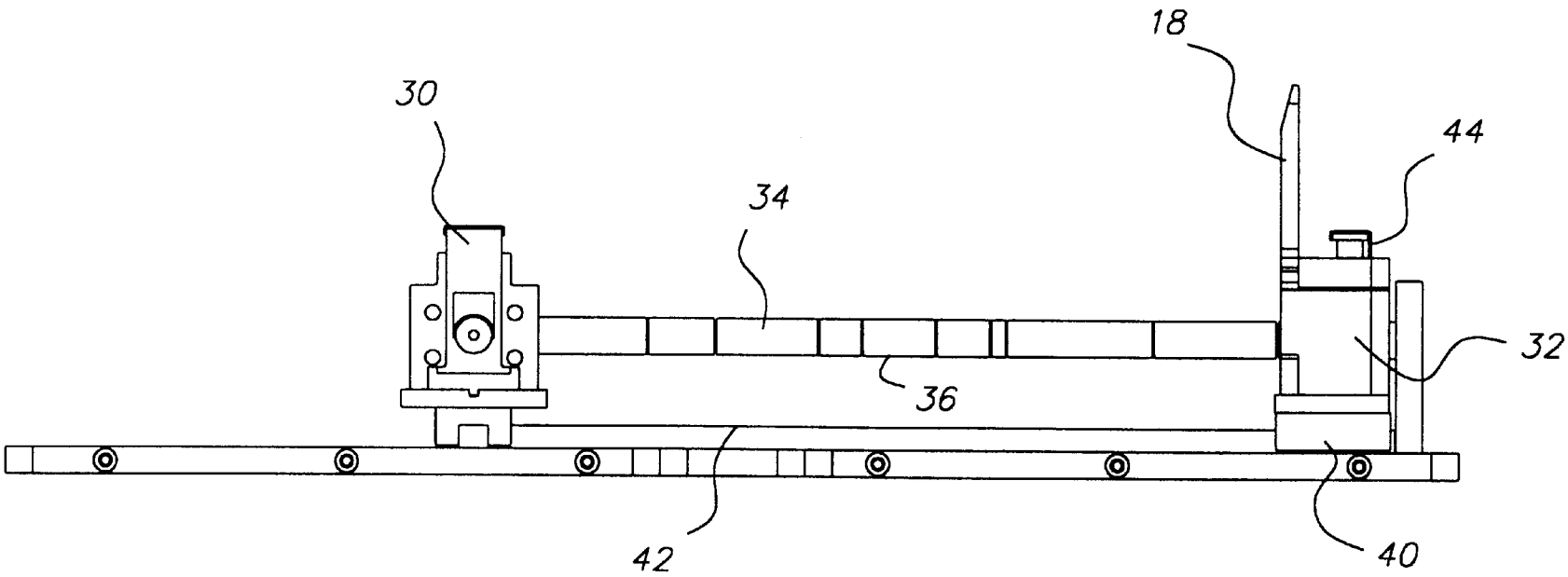
FIG. 3 is a partial side view of the adjustment mechanism for the adjustable guides.

Referring now to FIG. 3, adjustable tray 10 further includes a first quick release/latch member 30 operably associated with the sheet width aligning guide member 18. First quick release/latch member 30 is provided for releasing the sheet width aligning guide member 18 from a first position along the first axis 22 and then securing the sheet width aligning guide member 18 in a second position along the first axis 22.

Similarly, a second quick release/latch member (not shown) is operably associated with the sheet receiving guide member 20. Second quick release/latch member is provided for releasing the sheet receiving guide member 20 from a first position along the second axis 24 and then securing the sheet receiving guide member 20 in a second position along the second axis 24.

According to FIG. 3, preferably, first quick release/latch member 30 is supported in a housing 32 for releasing and latching the sheet width aligning guide member 18 by an adjustable rod 34. Adjustable rod 34 has a plurality of slots 36 for engaging first quick release/latch member 30 in a plurality of positions along platform 12. Although not shown, second quick release/latch member governing the sheet receiving guide member 20 has a similar adjustable rod (not shown) and a plurality of slots (not shown) for engaging the second quick release/latch member in a plurality of positions along the platform 12. A return spring 44 supportedly mounted in housing 32 biases the sheet width aligning guide member 18. Similarly, a return spring (not shown) biases the sheet receiving guide member 20. Both the guide members 18, 20 are adjusted by pressing the custom quick release/latch member 30 (only one shown) and sliding the guide members 18, 20 to the discrete adjustment slots 36 along the adjustment rod 34 until the interface of the quick release/latch member 30 and slots 36 in adjustment rod 34 engage, as shown in FIG. 3.

Referring still to FIG. 3, skilled artisans will appreciate that to achieve smooth movement of the guide members 18, 20, some sort of bearing 40 and a bearing rail 42 supporting the bearing 40 may be operably associated with each of the sheet width aligning guide member 18 and sheet receiving guide member 20 (only one bearing arrangement shown).

In an alternative embodiment, adjustable tray 10 for receiving and storing sheets of web material or paper 1 having a predetermined width (w) and length (l) includes platform 12 (as described above) for stacking sheets of web material or paper. According to FIGS. 1 and 2, platform 12 has a first guide slot 38 substantially normal to a second guide slot 46.

Referring to FIG. 1 and 2, first lateral edge guide 14 is substantially parallel to the first guide slot 38 and the second lateral edge guide 16 is substantially parallel to the second guide slot 46.

Referring to FIGS. 1 and 2, sheet width aligning guide member 18 may be disposed for slidable movements in both a plurality of first grooves 50 formed in the platform 12 and in the second guide slot 46. Similarly, sheet receiving guide member 20 may be disposed for movement along grooves 52 formed in platform 12 and in the first guide slot 38. Grooves 50, 52 and guide members 18, 20, respectively, form a rake/slot interface that prevent sheets of web material or paper from inadvertently becoming wedged between the guide members 18, 20 and the platform 12, as shown in FIG. 1.

In yet another embodiment of the invention, a method of feeding sheets of web material or paper 1 into an adjustable tray 10 includes providing the adjustable tray 10, as described in detail above. At least one sheet of web material or paper 1 for feeding into the tray 10 is provided and positioned for feeding.

Figure 4:
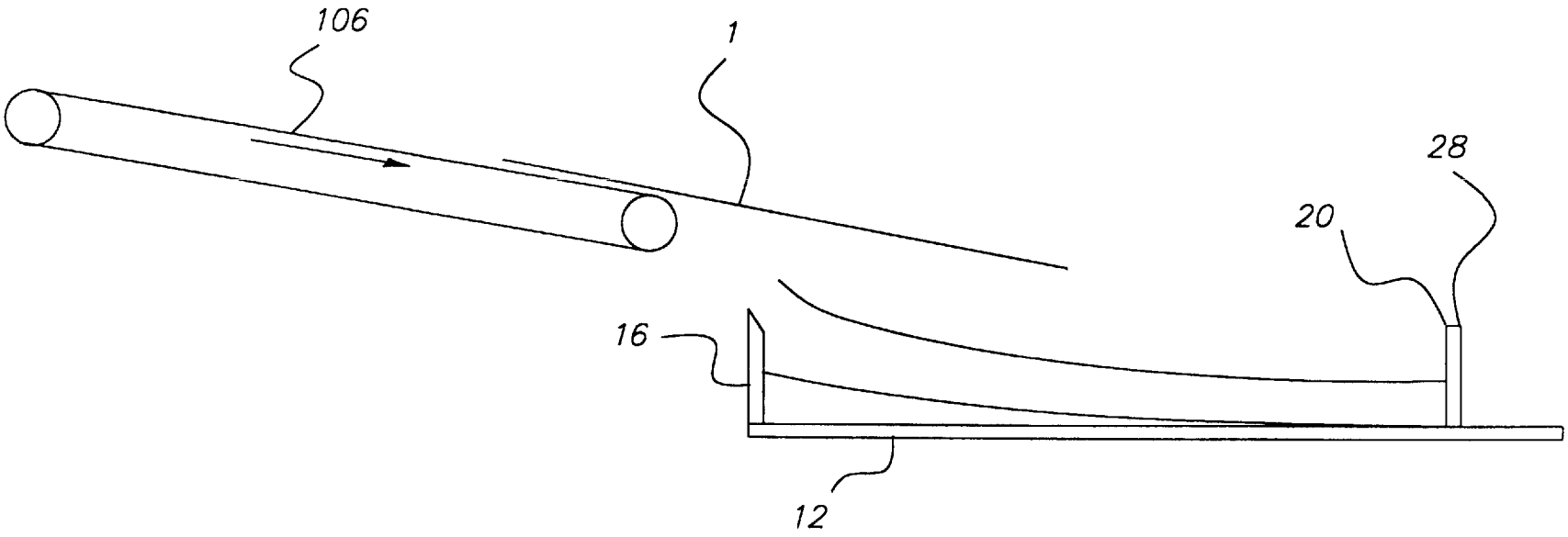
FIG. 4 is an elevated side view of the sheets being fed from typical sheet processing equipment into the adjustable tray.

Referring to FIGS. 1 and 4, the sheet width aligning guide member 18 and sheet receiving guide members 20 (as described above) are preset to correspond to a predetermined width and length of the sheets of web material or paper 1 being fed. The sheets of web material or paper 1 being fed are positioned relative to a top edge 28 of the sheet receiving guide member 20 of tray 10. Once this is achieved, a leading edge of at least one sheet is directed downwardly towards the sheet receiving guide member 20 until the at least one sheet settles on the platform 12 between the first lateral edge guide 14, the second lateral edge guide 16, and the sheet width aligning guide member 18.

Figure 5:
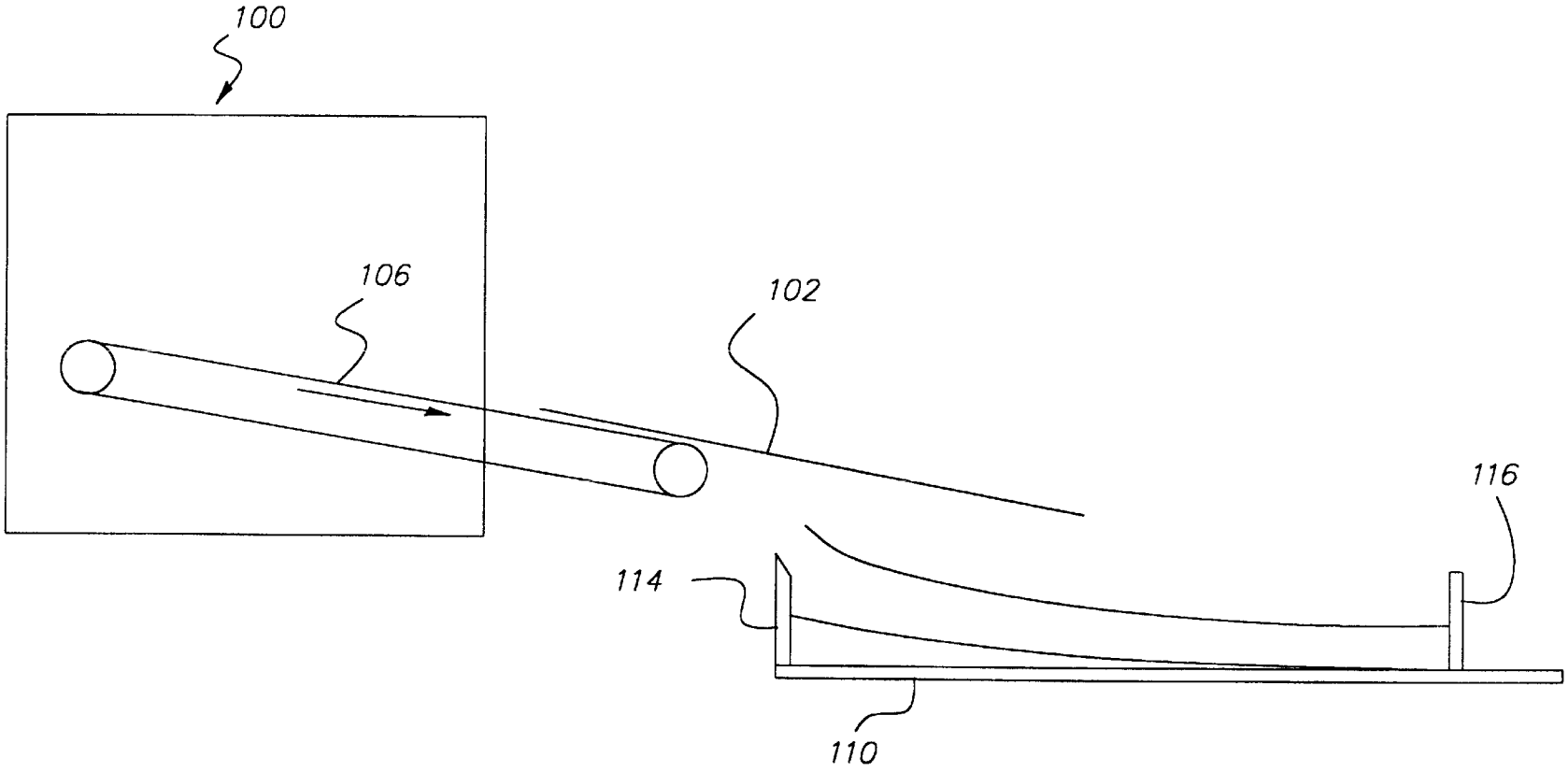
FIG. 5 is a side elevated view of the sheets fed singly from a processing apparatus of the invention into the adjustable tray.
Figure 6:
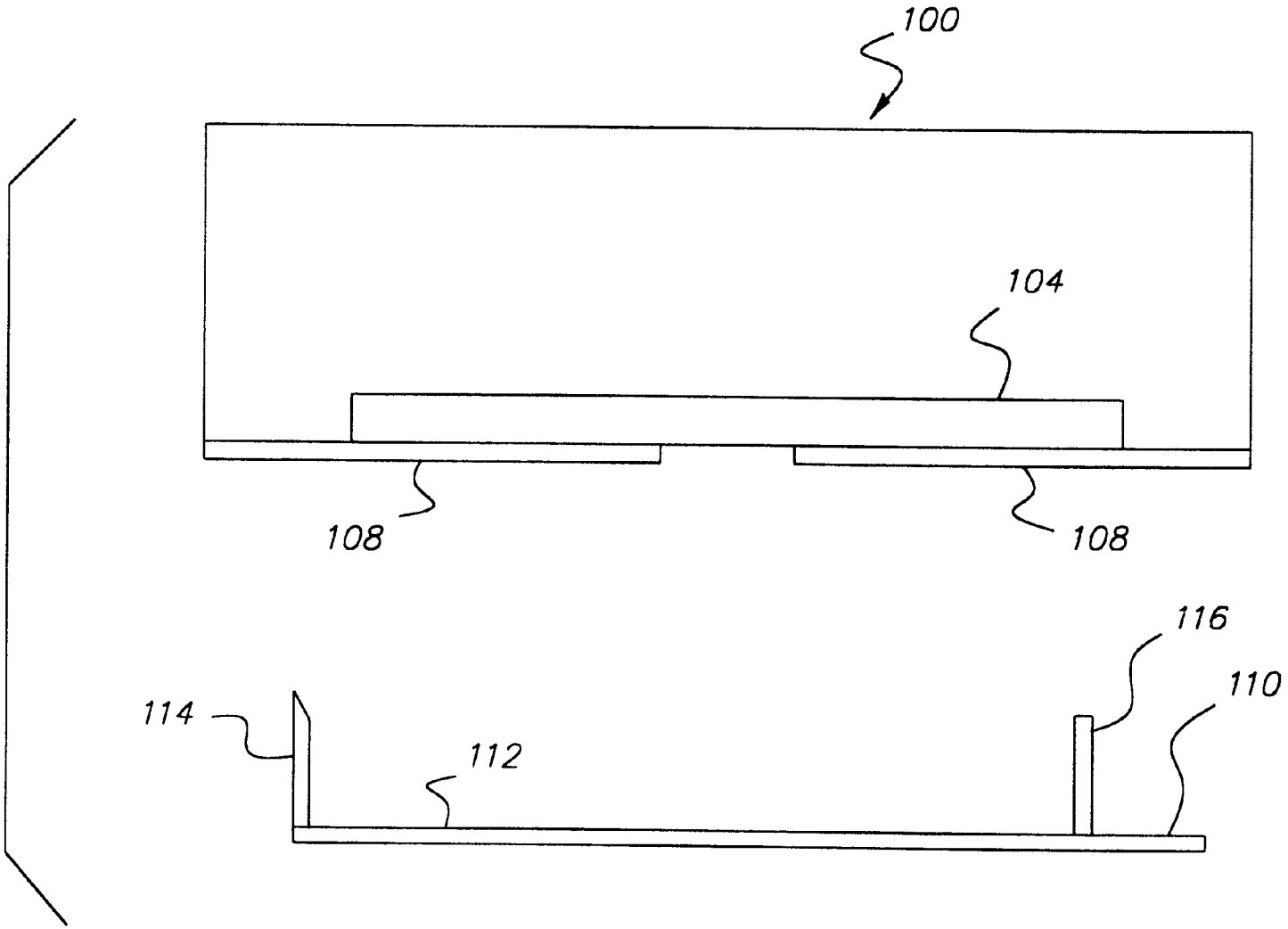
FIG. 6 is a side elevated view of the apparatus positioned to dump a stack of processed sheets into the adjustable tray; and, FIG. 7 is a side elevated view of the apparatus of FIG. 6 with the stack of sheets positioned on the adjustable tray.
Figure 7:
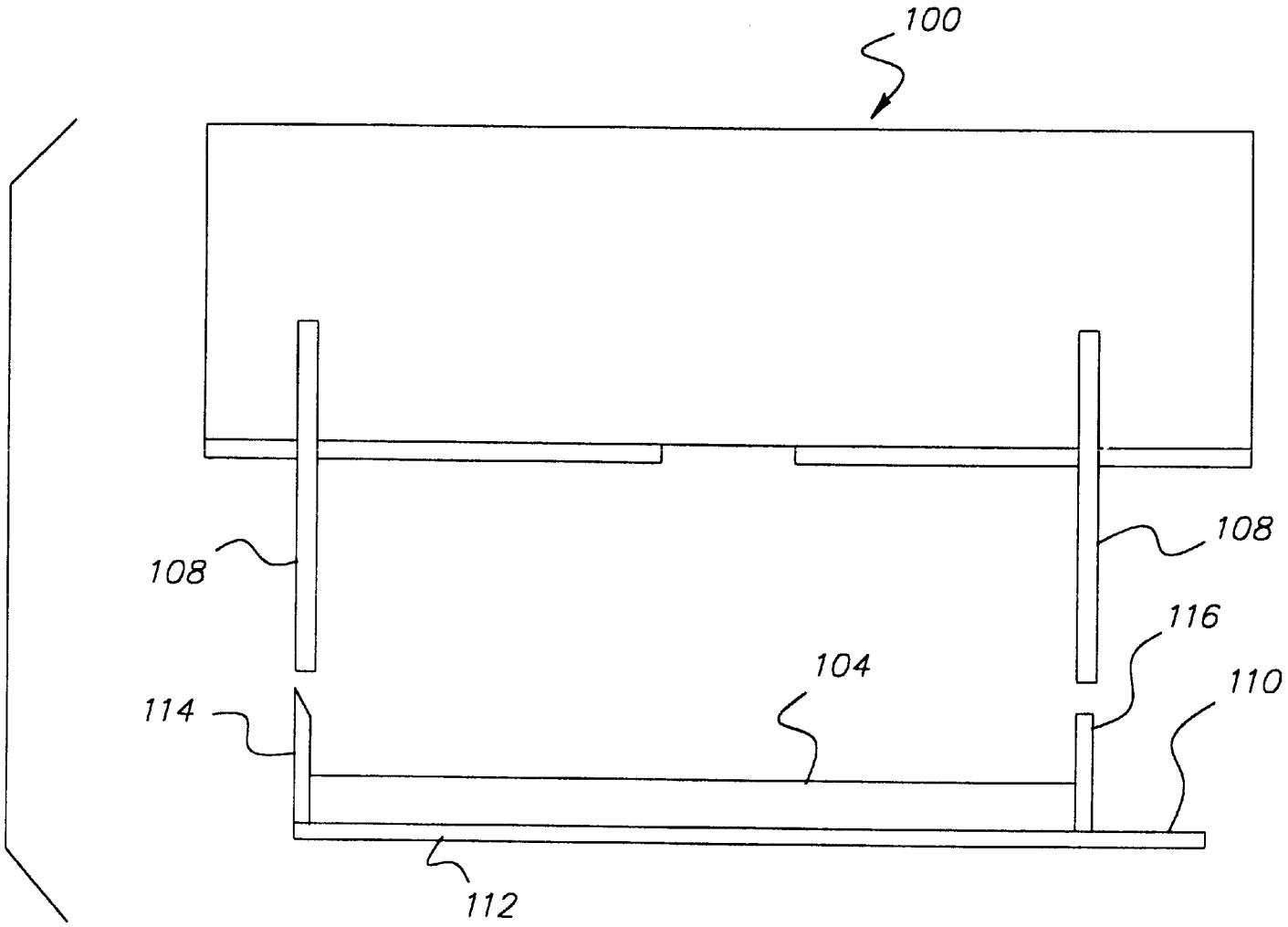

Referring to FIGS. 5–7, in an alternative embodiment of the invention, an apparatus 100 for processing sheets of web material or paper 102, such as a chopper, cuts sheets of photographic paper or film to a predetermined length and width and then delivers the cut sheets of web material or paper 102 to an adjustable tray 110 (as described above) for further processing. Generally, apparatus 100 may accommodate a large diameter of roll product, such as film or paper, which is fed into apparatus 100 for processing. According to FIG. 5, the cut sheets of web material or paper

102 processed in apparatus 100 of the invention may be accumulated singly onto a conveyor 106 (FIGS. 4 and 5) and then fed into adjustable tray 110. Alternatively, as shown in FIG. 6, the sheets of web material or paper 102 may be accumulated into a stack 104 and the entire stack 104 may be dumped via openable doors 108 onto platform 112 of adjustable tray 110 between second lateral edge guide 114 and sheet receiving guide member 116, as shown in FIG. 7. In either embodiment, the adjustable tray 110 of apparatus 100 is positioned in such a manner as to allow all the sheets of web material or paper 102 to settle into a stack 104 on platform 112 within the adjustable tray 110, as described above.

The invention has been described with reference to a preferred embodiment. However, it will be appreciated that variations and modifications can be effected by a person of ordinary skill in the art without departing from the scope of the invention.

PARTS LIST

1 sheets of web material or paper
10 adjustable tray
12 platform
14 first lateral edge guide
16 second lateral edge guide
18 sheet width aligning guide member
20 sheet receiving guide member
22 first axis along platform 12
23 tapered top edge of guide member 18
24 second axis along platform 12
28 top edge of sheet receiving guide member 20
30 first quick release/latch member
32 housing
34 adjustment rod
36 plurality of slots
38 first guide slot
40 bearing
42 bearing rail
44 return spring
46 second guide slot
50 plurality of first grooves
52 plurality of second grooves
100 apparatus for processing sheets of paper
102 sheet of web material or paper
104 stack of sheets of web material or paper
106 conveyor
108 openable door
110 adjustable tray
112 platform
114 second lateral edge guide
116 sheet receiving guide member

What is claimed is:

1. An adjustable tray for receiving and storing sheets of paper having a predetermined width and length, comprising:

a platform for stacking sheets of paper;

a first lateral edge guide arranged substantially normal to a second lateral edge guide on said platform; and, a sheet width aligning guide member and a cooperating sheet receiving guide member, said sheet width aligning guide member being arranged in proximate contact along its entire length with said platform for adjustable movements along a first slot in said platform towards and away from said first lateral edge guide, said cooperating sheet receiving guide member being arranged for adjustable movements along a second slot of said platform towards and away from said second lateral edge guide, and wherein said sheet width aligning guide member and said sheet receiving guide member each having a plurality of tabs extending proximately in grooves in said platform to prevent sheets of paper from being trapped therein during operations.

2. The tray recited in claim 1 wherein said sheet width aligning guide member is substantially tapered along a top edge.

3. The tray recited in claim 1 wherein said sheet receiving guide member is in proximate contact with said platform and is substantially flat along a top edge.

4. The tray recited in claim 1 wherein a first quick release/latch member operably associated with said sheet receiving guide member is provided for releasing said sheet receiving guide member from a first position along said first axis and then securing said sheet receiving guide member in a second position along said first axis.

5. The tray recited in claim 4 wherein said first quick release/latch member is supported for releasing and latching said sheet width aligning guide member by an adjustable rod, said adjustable rod having a plurality of slots for engaging said first quick release/latch member.

6. The tray recited in claim 1 wherein a second quick release/latch member operably associated with said sheet width aligning guide member is provided for releasing said sheet width aligning guide member from a first position along said second axis and then securing said sheet width aligning guide member in a second position along said second axis.

7. The tray recited in claim 1 wherein a bearing and a bearing rail supporting said bearing are operably associated with each said sheet width aligning guide member and said sheet receiving guide member enabling movement of said sheet width aligning guide member and said sheet receiving guide member.

8. An adjustable tray for receiving and storing sheets of paper having a predetermined width and length, comprising:

a platform for stacking said sheets of paper, said platform having a first guide slot substantially normal to a second guide slot;

a first lateral edge guide supported on a first portion of said platform and an adjoining second lateral edge guide supported on a second portion of said platform substantially normal to said first lateral edge guide, said first lateral edge guide being in proximate contact with said platform and substantially parallel to said first guide slot and said second lateral edge guide being substantially parallel to said second guide slot;

a sheet width aligning guide member disposed for slidable movements in both a plurality of first grooves formed in said platform and in said first guide slot towards and away from said first lateral edge guide, said slidable movements enabling said sheet width aligning guide member to alignably accommodate said sheets of paper having a predetermined width; and, a sheet receiving guide member cooperatively associated with said sheet width aligning guide member for conforming with said predetermined width and length, said sheet receiving guide member being disposed for slidable movements in both a plurality of grooves formed in said platform and in said second guide slot towards and away from said second lateral edge guide, said sheet receiving guide member being adjustable for align ably accommodating said sheets of paper having a predetermined length.

9. The tray recited in claim 8 wherein said sheet width aligning guide member is substantially tapered along a top edge.

10. The tray recited in claim 8 wherein said sheet receiving guide member is substantially flat along a top edge.

11. The tray recited in claim 8 wherein a first quick release/latch member operably associated with said sheet receiving guide member is provided for releasing said sheet receiving guide member from a first position in said first guide slot and then securing said sheet receiving guide member in a second position in said first guide slot.

12. The tray recited in claim 11 wherein said first quick release/latch member is supported for releasing and latching said sheet width aligning guide member by an adjustable rod, said adjustable rod having a plurality of slots for engaging said first quick release/latch member.

13. The tray recited in claim 8 wherein a second quick release/latch member operably associated with said sheet width aligning guide member is provided for releasing said sheet width aligning guide member from a first position in said second guide slot and then securing said sheet width aligning guide member in a second position in said second guide slot.

14. The tray recited in claim 8 wherein a bearing and a bearing rail supporting said bearing are operably associated with said sheet width aligning guide member and said sheet receiving guide member enabling movement of said sheet width aligning guide member and said sheet receiving guide member.

15. A method of feeding sheets of paper into a tray comprising the steps of:

providing an adjustable tray comprising: a platform for stacking sheets of paper; a first lateral edge guide arranged substantially normal to a second lateral edge guide on said platform and, a sheet width aligning guide member and a cooperating sheet receiving guide member, said sheet width aligning guide member being arranged in proximate contact along its entire length with said platform for adjustable movements along a first slot of said platform towards and away from said first lateral edge guide, and said cooperating sheet receiving guide member being arranged for adjustable movements along a second slot of said platform towards and away from said second lateral edge guide, and wherein said sheet width aligning guide member and said cooperating sheet receiving guide member each having a plurality of tabs extending proximately in grooves in said platform to prevent sheets of paper from being trapped therein during operations;

providing at least one sheet of paper for feeding into said tray;

presetting said sheet width aligning guide member and said cooperating sheet receiving guide member to correspond to a predetermined width and length of said sheets of paper being fed;

positioning said at least one sheet of paper to clear a top edge of said second lateral edge guide; and, directing a leading edge of said at least one sheet downwardly towards said cooperating sheet receiving guide member until said at least one sheet clears said top edge of said second lateral edge guide and settles on said platform between said cooperating sheet receiving guide member, said second lateral edge guide member, and said sheet width aligning guide member.

16. The method according to claim 15 wherein said step of presetting said cooperating sheet receiving guide member includes the step of: slidably moving said cooperating sheet receiving guide member along a first fixed axis through said platform towards or away from said second lateral edge guide; and, wherein presetting said sheet width aligning guide member includes the step of slidably moving said sheet width aligning guide member along a second fixed axis passing through said platform towards or away from a first lateral edge guide.

17. The method according to claim 15 wherein said step of providing an adjustable tray further includes the step of providing a tapered edge on a top portion of said first lateral edge guide and said second lateral edge guide.

18. The method according to claim 15 wherein said step of providing an adjustable tray further includes the step of providing a first quick release/latch member operably associated with said cooperating sheet receiving guide member for releasing said cooperating sheet receiving guide member from a first position in a first guide slot and then securing said cooperating sheet receiving guide member in a second position in said first guide slot.

19. The method recited in claim 15 wherein said step of providing an adjustable tray further includes the step of providing a second quick release/latch member operably associated with said sheet width aligning guide member for releasing said sheet width aligning guide member from a first position in a second guide slot and then securing said sheet width aligning guide member in a second position in said second guide slot.

20. The method recited in claim 15 wherein said step of providing an adjustable tray further includes providing a bearing and a bearing rail supporting said bearing operably associated with said sheet width aligning guide member and said cooperating sheet receiving guide member for enabling smooth movement of said sheet width aligning guide member and said cooperating sheet receiving guide member.

* * * * *